US008056185B2

(12) United States Patent
Lai

(10) Patent No.: US 8,056,185 B2
(45) Date of Patent: Nov. 15, 2011

(54) GRIP STRUCTURE OF A RETRACTABLE HANDLE FOR TRAVEL BAG

(76) Inventor: Wei-Hung Lai, Taichung (TW)

( * ) Notice: Subject to any disclaimer, the term of this patent is extended or adjusted under 35 U.S.C. 154(b) by 376 days.

(21) Appl. No.: 12/457,467

(22) Filed: Jun. 11, 2009

(65) Prior Publication Data

US 2010/0313383 A1 Dec. 16, 2010

(51) Int. Cl.
*A47B 95/02* (2006.01)

(52) U.S. Cl. ..... 16/113.1; 16/114.1; 16/405; 16/429; 16/900

(58) Field of Classification Search ..... 16/113.1, 16/114.1, 405, 408, 427, 429, 430, 900; 294/57, 294/58, 167; 190/115; 280/655.1
See application file for complete search history.

(56) References Cited

U.S. PATENT DOCUMENTS 6,865,777 B2 * 3/2005 Comstock ..... 16/114.1
6,874,604 B2 * 4/2005 Miller et al. ..... 16/113.1
7,168,537 B2 * 1/2007 Bellini ..... 16/113.1
2003/0000785 A1 * 1/2003 Miller et al. ..... 16/113.1
2004/0238304 A1 * 12/2004 Fisher ..... 16/113.1
2005/0241900 A1 * 11/2005 Fisher ..... 190/115

* cited by examiner

*Primary Examiner* — Victor Batson
*Assistant Examiner* — Jeffrey O Brien
(74) *Attorney, Agent, or Firm* — Rosenberg, Klein & Lee

(57) ABSTRACT

A grip structure includes two holder bars respectively affixed to two inner tubes in two outer tubes of a retractable handle for travel bag, two locating rings respectively mounted in the holder bars, a grip formed of two symmetrical annular half shells and pivotally coupled between the two locating rings; two control bolts respectively movably supported in the locating rings, and a spring-supported operating member mounted in the grip and operable to move the control bolts between a first position where the inner tubes are locked to the outer tubes and the control bolts are engaged with the locating rings to lock the grip to the inner tubes and a second position where the inner tubes are unlocked from the outer tubes and the control bolts are biasable with the grip relative to the inner tubes of the retractable handle.

2 Claims, 5 Drawing Sheets

GRIP STRUCTURE OF A RETRACTABLE HANDLE FOR TRAVEL BAG

BACKGROUND OF THE INVENTION

1. Field of the Invention

The present invention relates to a retractable handle for travel bag and more particularly to a loop-shaped grip structure for retractable handle that can be rotated relative to the retractable handle and locked to the desired angle for comfortable gripping.

2. Description of the Related Art

A conventional retractable handle for travel bag, as shown in FIG. 1, comprises two outer tubes 1 affixed to the frame structure of a travel bag in a parallel manner, two inner tubes 2 respectively slidably inserted into the outer tubes 1, a grip formed of a top cover shell 3 and a bottom cover shell 4 and transversely fixedly connected between the top ends of the inner tubes 2, and a control button 5 installed in the top cover shell 3 of the grip for operation by a user to control locking/unlocking of the inner tubes 2.

According to the aforesaid design, the grip is fixedly connected between the top ends of the inner tubes and not rotatable relative to the inner tubes. The user's hand will receive a load and will feel uncomfortable when pulling the travel bag in a tilted condition.

SUMMARY OF THE INVENTION

The present invention has been accomplished to provide a grip structure for retractable handle for travel bag, which can be biased relative to the retractable handle to impart comfort to the user when the user is tilting the travel bag for enabling the travel bag to be moved in a tilted condition.

To achieve this and other objects of the present invention, the grip structure comprises two holder bars respectively affixed to two inner tubes being respectively slidably mounted in two outer tubes of a retractable handle for travel bag; two locating rings respectively mounted in the holder bars; a grip formed of two symmetrical annular half shells and pivotally coupled between the two locating rings; two control bolts respectively supported in the locating rings and movable between a first position where the control bolts are respectively engaged with the locating rings and a second position where the control bolts are respectively disengaged from the locating rings and biasable with the grip relative to the locating rings and the holder bars, the control bolts each having a beveled head; and a spring-supported operating member mounted in the grip and operable to move the control bolts between the first position and the second position, the spring-supported operating member having two beveled end blocks respectively abutted against the beveled heads of the control bolts.

DETAILED DESCRIPTION OF THE PREFERRED EMBODIMENT

Figure 1:
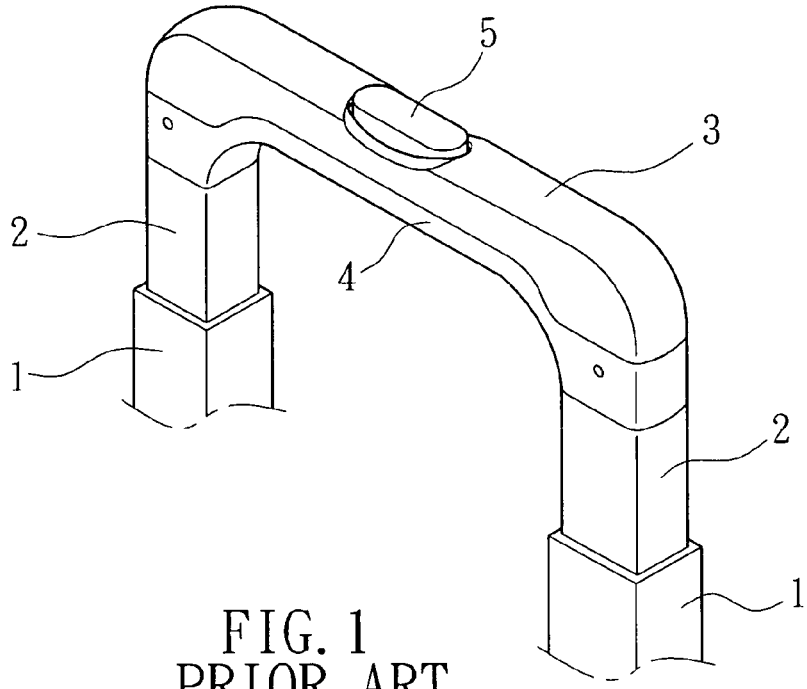
FIG. 1 PRIOR ART
FIG. 1 illustrates a grip structure of a retractable handle for travel bag according to the prior art.
Figure 2:
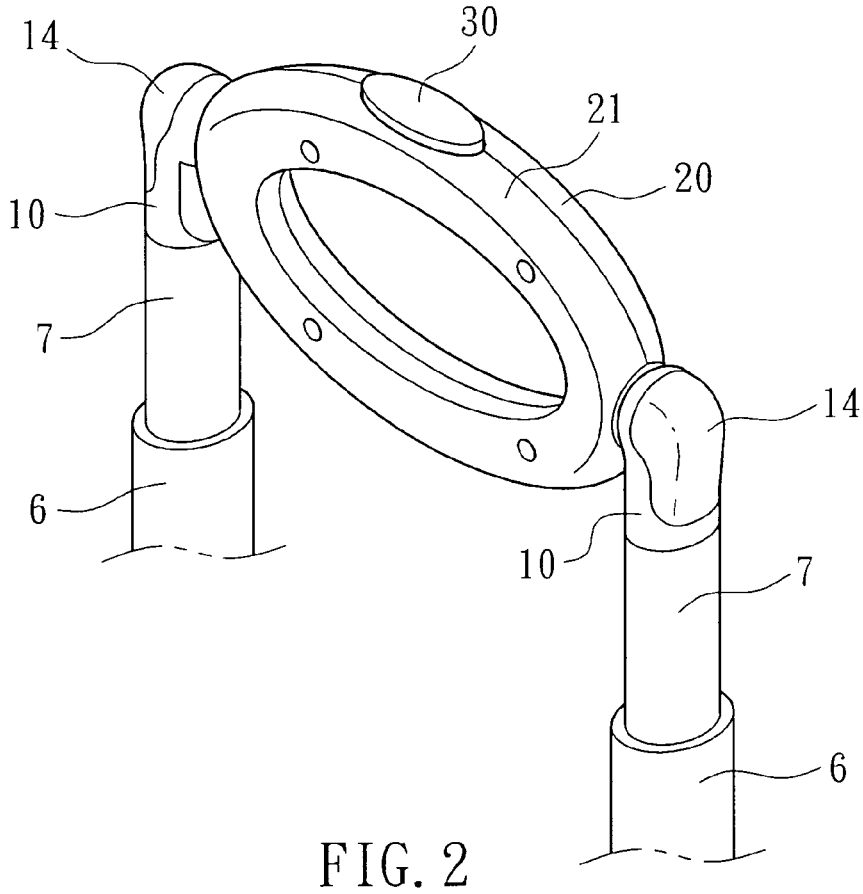
FIG. 2 is an elevational view of a grip structure of a retractable handle for travel bag constructed according to the present invention.
Figure 3:
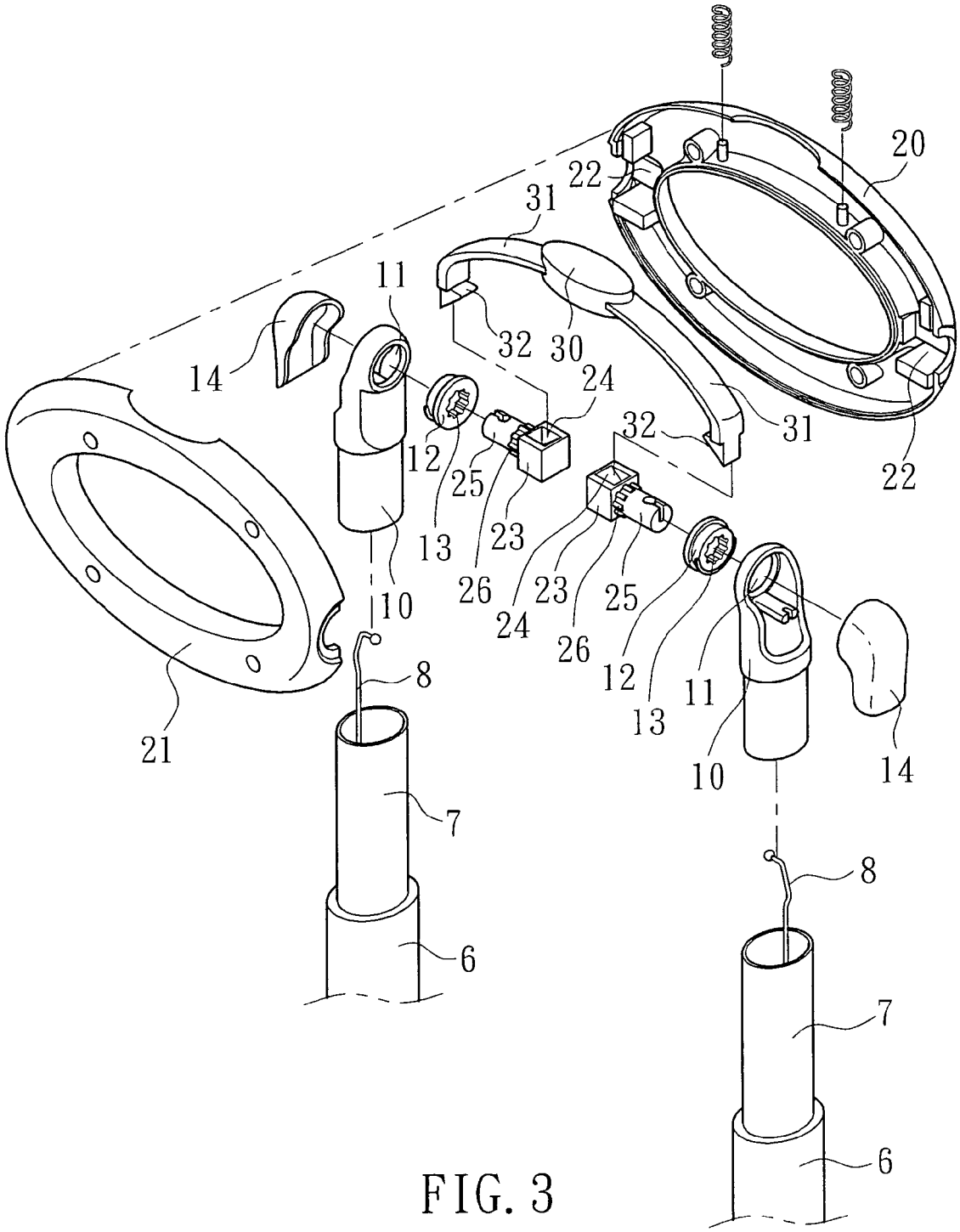
FIG. 3 is an exploded view in an enlarged scale of FIG. 2.
Figure 4:
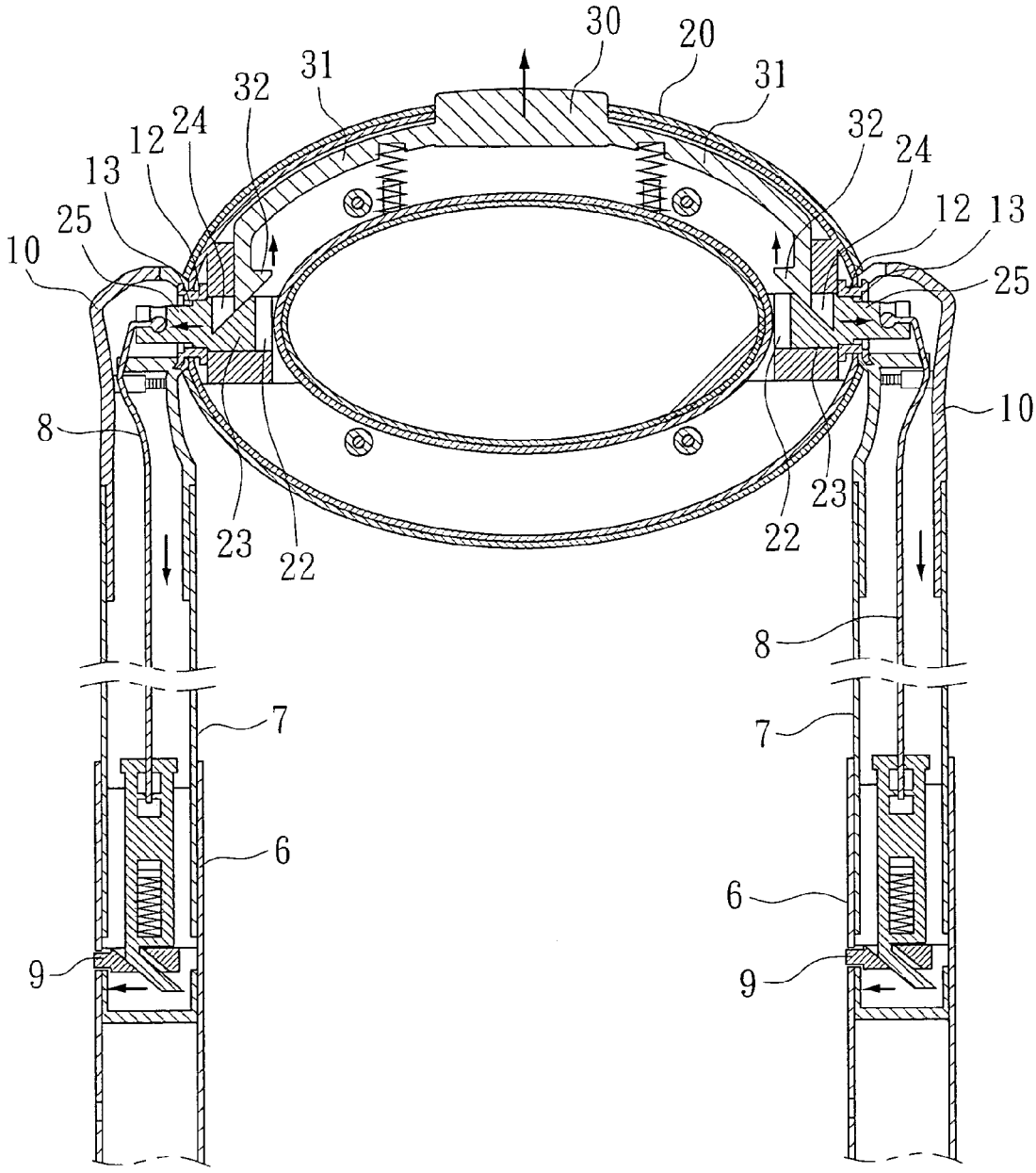
FIG. 4 is a sectional view in an enlarged scale of FIG. 2.

Referring to FIGS. 2~4, a grip structure is shown comprising:

two holder bars 10 respectively affixed to two inner tubes 7 in two outer tubes 6 of a retractable handle for travel bag, each holder bar 10 having an axle hole 11;

two locating rings 12 respectively mounted in the axle holes 11 of the holder bars 10, each locating ring 12 having a toothed portion 13 extending around the inside wall thereof;

two caps 14 respectively capped on the holder bars 10 to protect the locating rings 12 in the axle holes 11;

two control bolts 23 respectively supported in the locating rings 12 and movable between a first position where the control bolts 23 are immovable relative to the locating rings 12 and a second position where the control bolts 23 are movable relative to the locating rings 12, each control bolt 23 having a shank 25 pivotally inserted through the associating locating ring 12 and fixedly connected to one end of a respective wire member 8 in the associating inner tube 7, a beveled head 24 at one end of the shank 25 and a toothed portion 26 extending around the periphery of the shank 25 and abutted against the beveled head 24 for engagement with the toothed portion 13 of the associating locating ring 12 when the respective control bolt 23 is moved to the first position;

a spring-supported operating member 30 operable to move the control bolts 23 between the first position and the second position, the spring-supported operating member 30 having two arms 31 and two beveled end blocks 32 respectively located on the distal ends of the arms 31 and respectively abutted against the beveled heads 24 of the control bolts 23; and two annular half shells 20 and 21 fastened together to form a grip and to hold the arms 31 and beveled end blocks 32 of the spring-supported operating member 30 and the control bolts 23 on the inside, each of the annular half shells 20 and 21 having two holes 22 at two opposite side through which the shanks 25 of the control bolts 23 are moved in and out.

Figure 5:
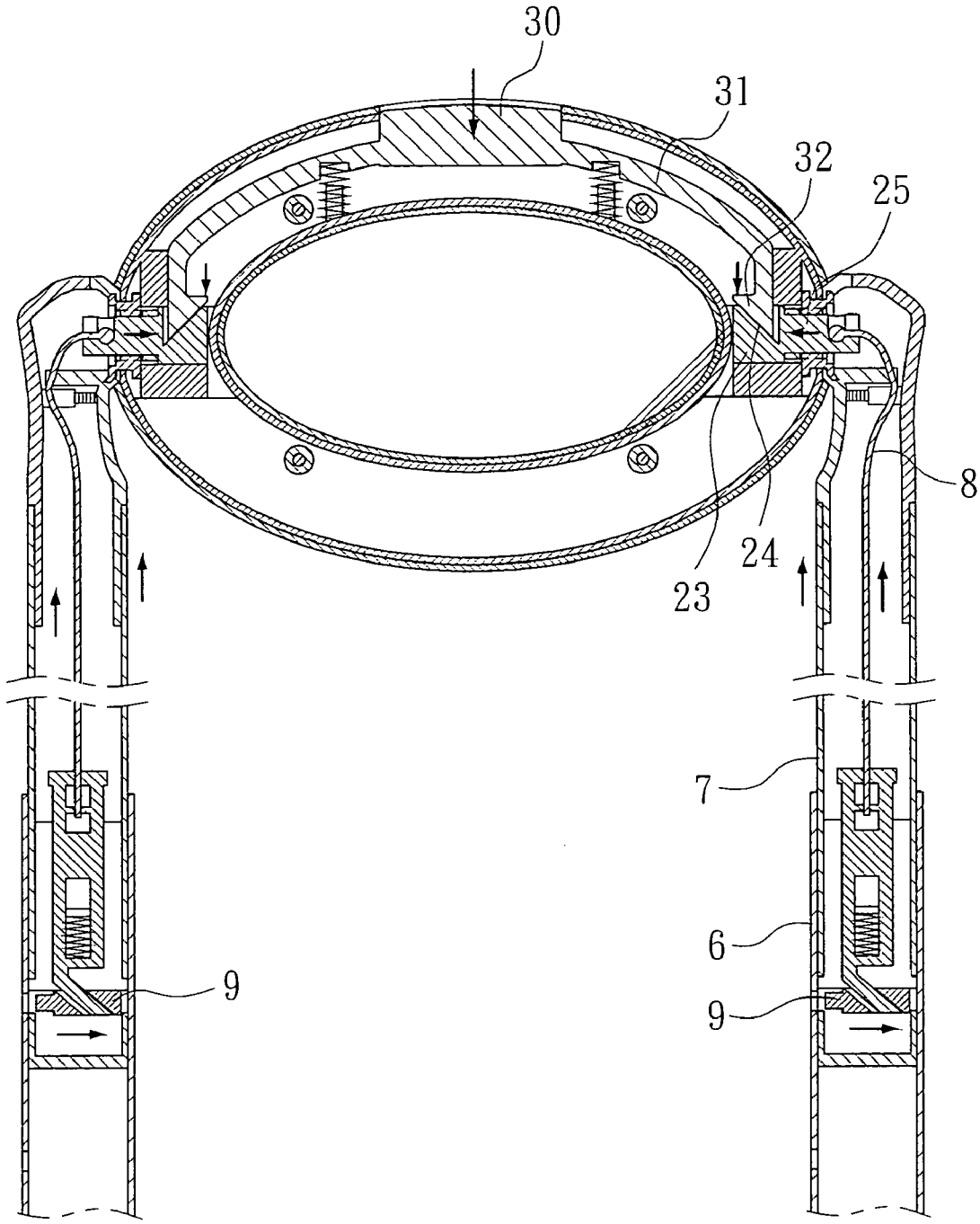
FIG. 5 is similar to FIG. 4 but showing the control bolts disengaged from the locating rings.
Figure 6:
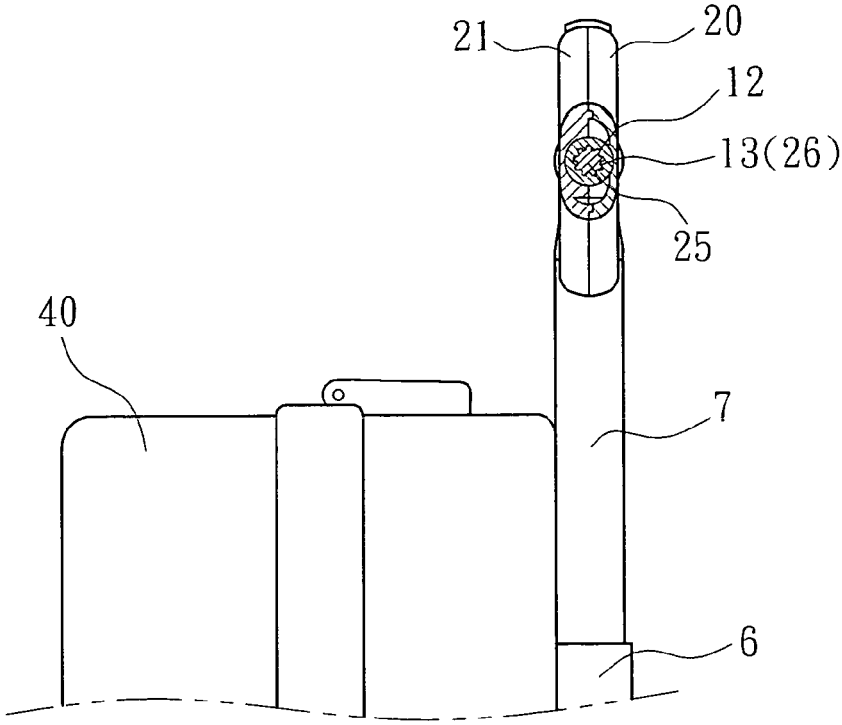
FIG. 6 is a schematic drawing of the present invention, showing the loop-like grip body set in vertical.
Figure 7:
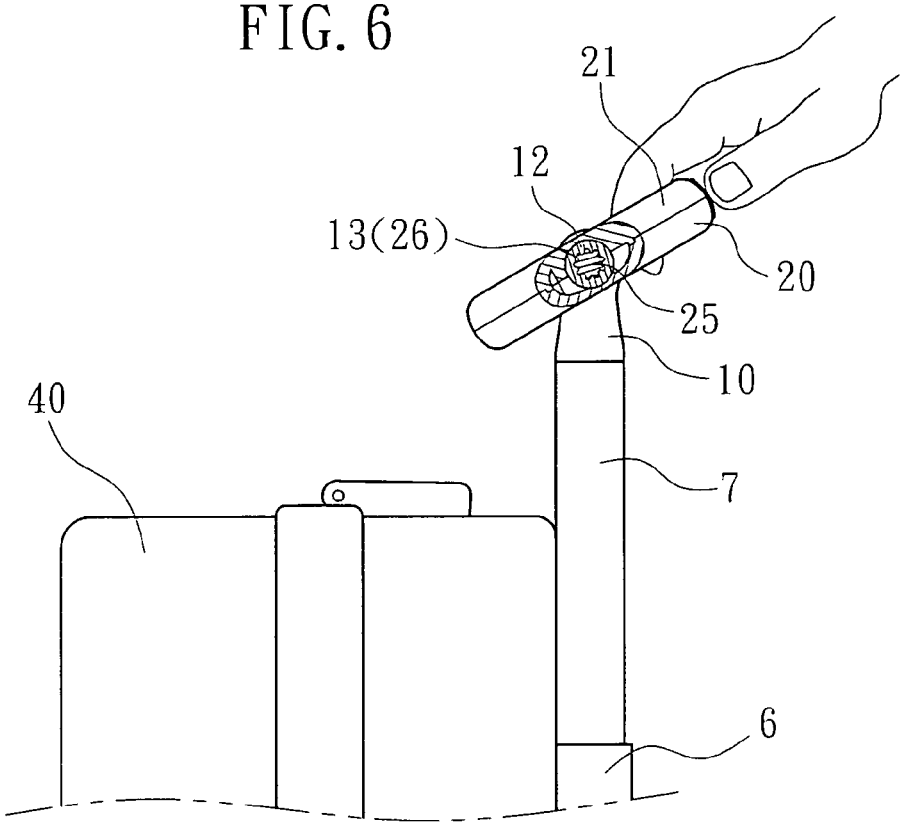
FIG. 7 is a schematic drawing of the present invention, showing the loop-like grip body set in horizontal.

Referring to FIG. 5 and FIG. 4 again, normally, the spring-supported operating member 30 is disposed in the first position where the toothed portions 26 of the control bolts 23 are respectively meshed with the toothed portions 13 of the locating rings 12, and the latches 9 at the bottom ends of the wire members 8 are respectively engaged into the inner tubes 7 and the outer tubes 6 to lock the retractable handle (see FIG. 4). When the user pressed the part of the spring-supported operating member 30 outside the annular half shells 20 and 21, the beveled end blocks 32 of the spring-supported operating member 30 are respectively forced against the beveled heads 24 of the control bolts 23 to move the control bolts 23 inwards from the first position to the second position (see FIG. 5). At this time, the toothed portions 26 of the control bolts 23 are respectively disengaged from the toothed portions 13 of the locating rings 12, and the wire members 8 are moved with the control bolts 23 to disengage the latches 9 from the outer tubes 6 for enabling the inner tubes 7 to be moved relative to the outer tubes 6 and also for enabling the spring-supported operating member 30 and the control bolts 23 to be biased with the annular half shells 20 and 21 relative to the holder bars 10 and the retractable handle (see FIGS. 6 and 7).

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A grip structure, comprising:

two holder bars respectively affixed to two inner tubes being respectively slidably mounted in two outer tubes of a retractable handle for travel bag;

two locating rings respectively mounted in said holder bars;

a grip formed of two symmetrical annular half shells and pivotally coupled between said two locating rings;

two control bolts respectively supported in said locating rings and movable between a first position where said control bolts are respectively engaged with said locating rings and a second position where said control bolts are respectively disengaged from said locating rings and pivotable with said grip relative to said locating rings and said holder bars, said control bolts each having a beveled head; and a spring-supported operating member mounted in said grip and operable to move said control bolts between said first position and said second position, said spring-supported operating member having two beveled end blocks respectively abutted against the beveled heads of said control bolts.

2. The grip structure as claimed in claim 1, wherein said locating rings each have an internal toothed portion; said control bolts each have an external toothed portion adapted for engaging the internal toothed portion of the associating locating ring.

* * * * *